United States Patent [19]

Gilmore, Jr.

[11] Patent Number: 4,693,384

[45] Date of Patent: Sep. 15, 1987

[54] EXCAVATOR BOOM DERRICK

[75] Inventor: Charles P. Gilmore, Jr., Ash Flat, Ark.

[73] Assignee: Gilmore Transportation Services, Inc., Houston, Tex.

[21] Appl. No.: 811,958

[22] Filed: Dec. 20, 1985

[51] Int. Cl.[4] ..... B66C 23/56

[52] U.S. Cl. ..... 212/257; 212/261; 212/238; 414/687

[58] Field of Search ..... 212/257, 228, 227, 226, 212/225, 261, 238; 414/687, 912

[56] References Cited

U.S. PATENT DOCUMENTS

| | | | |
|---|---|---|---|
| 489,635 | 1/1893 | Hemphill et al. | 212/228 |
| 2,042,388 | 5/1936 | Cogito et al. | 212/257 |
| 2,998,149 | 8/1961 | Bopp | 212/228 |
| 3,527,362 | 9/1970 | Allen | 212/238 |
| 3,855,954 | 12/1974 | Quick | 414/708 |
| 3,977,548 | 8/1976 | McCannon et al. | 414/687 |
| 3,985,249 | 10/1976 | Aker et al. | 414/687 |
| 4,214,840 | 7/1980 | Beales | 414/723 |
| 4,253,793 | 3/1981 | Brand | 414/723 |
| 4,355,945 | 10/1982 | Pilch | 414/686 |
| 4,571,146 | 2/1986 | Eriksson | 414/687 |

FOREIGN PATENT DOCUMENTS

| | | | |
|---|---|---|---|
| 616166 | 3/1961 | Canada | 212/228 |
| 932468 | 3/1948 | France | 212/228 |

*Primary Examiner*—Joseph F. Peters, Jr.
*Assistant Examiner*—Thomas J. Brahan
*Attorney, Agent, or Firm*—Bruns and Wall

[57] ABSTRACT

An articulated arm-type excavator machine has a boom which has a trolley track affixed onto its underside. A trolley member from which a pulley block can be suspended travels along this track, and is urged into an operator-selected position by a double-acting hydraulic cylinder. A power winch is mounted on the overcarriage of the machine and a lifting cable runs from the winch, over the pulley block, to a lifting hook or other device.

5 Claims, 4 Drawing Figures

EXCAVATOR BOOM DERRICK

BACKGROUND OF THE INVENTION

This invention relates to articulated crane-type machines, such as hydraulic excavators, and is more particularly directed to machines of the type having a front boom attachment. The invention is also directed towards derrick-type machines.

A derrick or similar lifting machine is often required on a building or construction site on which an excavator is also used. Normally, two separate machines, a derrick crane and an excavator, are transported to the site.

However, because of the high cost of these machines and the time and difficulty in transporting them, it is desired to find some suitable way to adapt the boom of an excavator for use as a derrick, so that one such machine can double on the other. That is, some means for attaching a cable and winch, with a block or sheave suspended from the boom. Preferrably, the radial position of the block or sheave along the boom should be adjustable to facilitate level transfer of an item being hoisted or lifted by the derrick. Using conventional techniques, it would be required to raise or lower the boom and at the same time to pay out or take up cable to maintain the carried object in a level plane. This is a slow and complex operation.

OBJECTS AND SUMMARY OF THE INVENTION

Accordingly, it is an object of this invention to provide an articulated crane-type machine which avoids the drawbacks of the prior art, and which can be employed as a derrick.

It is another object of this invention to provide an excavator-type machine which has a front attachment that can be used either as an excavator or as a boom derrick.

In accordance with an aspect of this invention, an articulated crane-type machine, such as a hydraulic excavator, has a base, an overcarriage swingably mounted on the base, a drive for swinging the overcarriage in a generally horizontal plane, a boom having its proximal end pivotally mounted on the overcarriage for motion in a generally vertical arc, and a boom cylinder or equivalent means for raising and lowering the boom in its arc. Affixed on an underside of the boom, towards its distal end, is a trolley track, with a trolley member being slidably held in the track. The trolley member includes structure for suspending a pulley block or other apparatus therefrom. A hydraulic cylinder is attached to the underside of the boom near its proximal end, and has a cylinder rod connected to the trolley member. The cylinder serves to urge the trolley member to an operator-selected position along the track.

A winch is mounted on the overcarriage and has a drum on which a lifting cable is wound and a power drive for turning the drum to pay out or rewind the cable under control of the operator. The cable extends over the pulley block that is suspended from the trolley member, and a lifting element, such as a lifting hook, is suspended from the lifting cable. In a preferred embodiment, the trolley track is formed of a pair of facing channel members that are affixed, e.g. by welding, to the underside of the boom. These channels have facing lower flanges on which rollers of the trolley run.

The above and many other objects, features and advantages of this invention will be more fully understood from the ensuing detailed description of a preferred embodiment, when considered in connection with the accompanying drawing.

DETAILED DESCRIPTION OF THE PREFERRED EMBODIMENT

Figure 1:
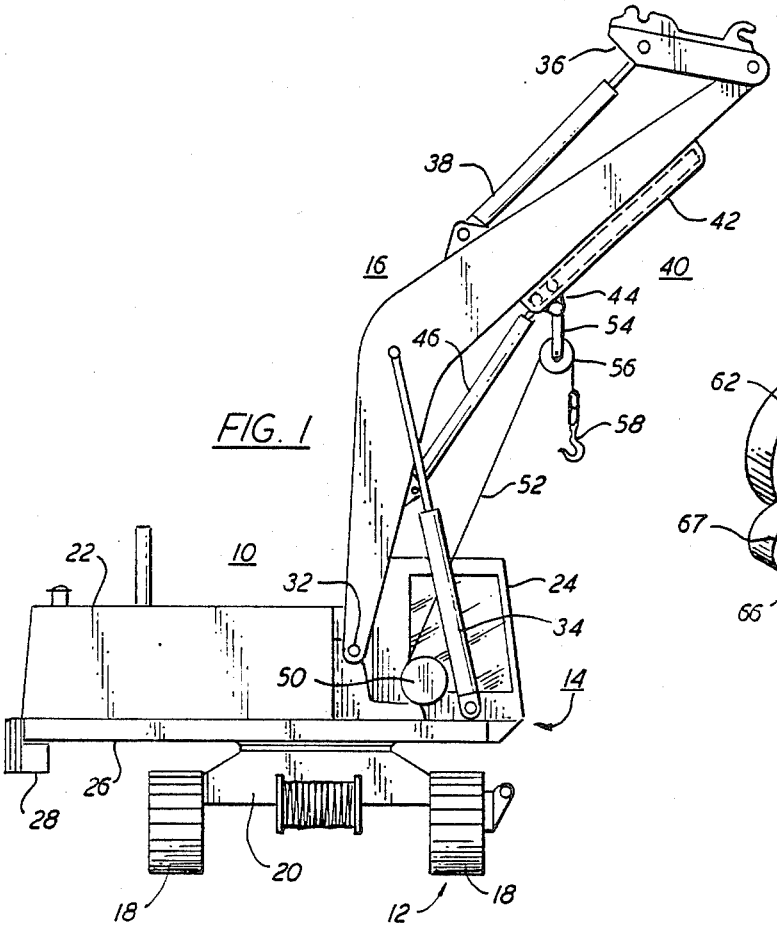
FIGS. 1 and 2 are perspective views of the machine of a preferred embodiment of this invention, showing a boom trolley in withdrawn and extended positions, respectively.
Figure 2:
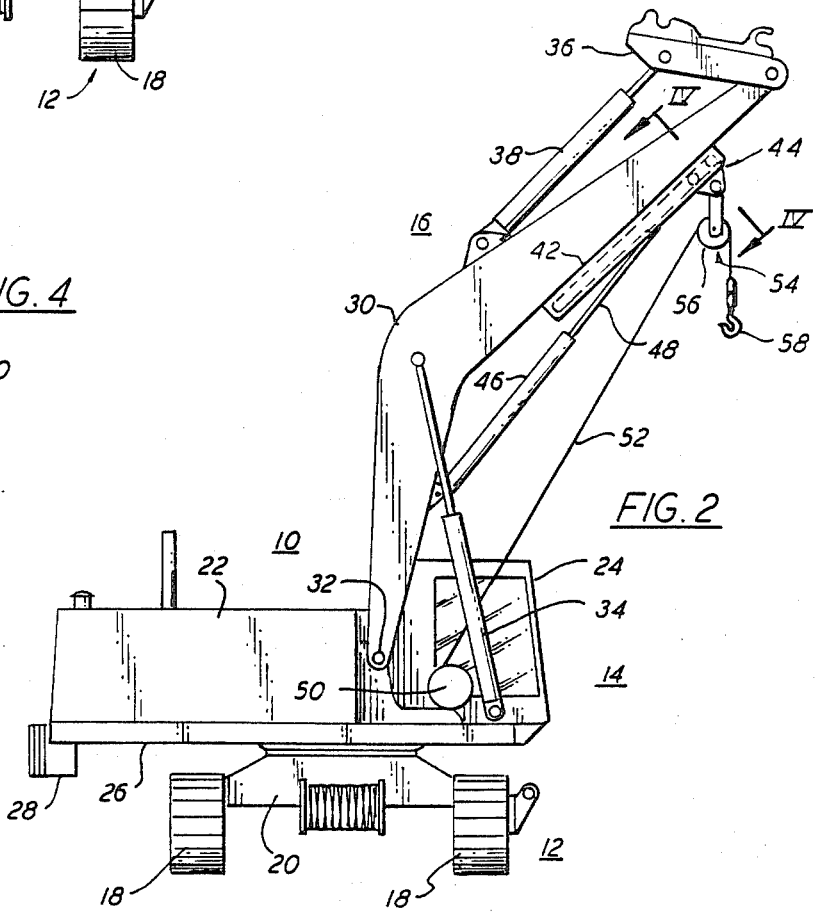

With reference to FIGS. 1 and 2 of the drawing, a crane-type hydraulic excavator machine 10 is shown to have an undercarriage 12, an overcarriage 14, and a front attachment 16. The undercarriage 12 consists basically of track and roller assemblies 18 and a carbody and swing bearing assembly 20. The overcarriage 14 of the excavator machine 10 has an engine compartment 22 which contains the prime mover engine for the machine and also contains the hydraulic system, an operator's cab 24, a platform 26 which is mounted for swingable action on the carbody and swing bearing assembly 20, and a counterpoise 28 at the end remote from the cab 24.

The front attachment 16 of the machine 10 is formed of a dog-leg or arched boom 30 whose proximal end is mounted by means of a pivot pin 32 to the overcarriage 14. A boom cylinder 34 has a cylinder end mounted to the platform 26 and has its rod end connected to the arch of the boom 30. A quick-disconnect shoe 36, discussed in greater detail in any co-pending patent application Ser. No. 795,102 filed Nov. 4, 1985, is rockably mounted at the distal end of the boom 30, and a stick cylinder 38 has a cylinder end mounted on the boom 30 and a cylinder rod coupled to a point on the quick-connect shoe 36 spaced from its mounting on the distal end of the boom 30. The shoe 36 permits secure attachment of a desired stick, (not shown) e.g. having a shovel end or a shear end, and facilitates removal of the stick when it is not needed. A boom trolley system 40 is disposed on the underside of the boom, and principally on its distal half. This system 40 has a trolley track or rail 42 which extends along the underside of the boom 30 a substantial portion of the part of the boom 30 beyond the arch. A trolley member 44 travels the length of the track 42 and is driven by a trolley cylinder 46, which is favorably a double-acting hydraulic cylinder. The latter has one end attached to the boom 30 towards its proximal end, and has a cylinder rod 48 (withdrawn in FIG. 1 and extended in FIG. 2) connected to a point on the trolley member 44.

A hydraulically powered winch is employed, and here has a winch drum 50 mounted on the overcarriage 14. A lifting cable 52, wound on the drum 50, extends over a block 54 that is suspended from the trolley member 44, the cable 52 passing through a pulley or sheave 56 in the block 54. A lifting hook 58 is affixed to the free end of the cable 52. If a greater mechanical advantage is required, a pulley or sheave can be attached to the lifting hook 58.

Figure 3:
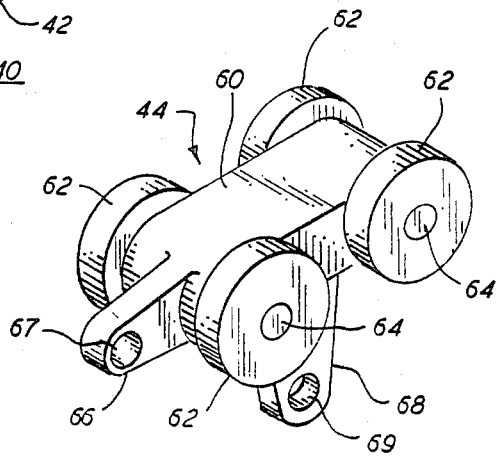
FIG. 3 is a perspective view of a trolley member of this embodiment.

As shown in FIG. 3, the trolley member 44 has a unitary body 60 on which there are four rollers or wheels 62 affixed on axles or pivots 64. The rollers 62 are attached one at each corner of the body 60, so that there are two rollers 62 on each side. A rear protuberance 66 has an opening or eye 67 to which the cylinder rod 48 is attached, and a depending finger 68 has an eye 69 from which the block 64 is suspended.

Figure 4:
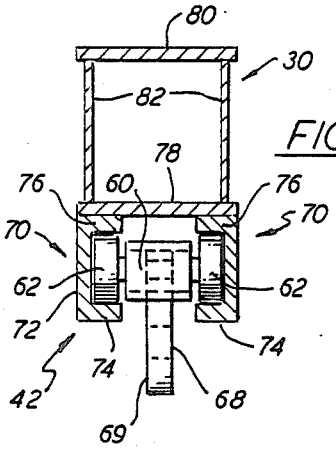
FIG. 4 is a cross-section of a portion of the machine of FIG. 2, taken along lines IV-IV.

As shown in FIG. 4, the track 42 is formed of a pair of channel members 70 affixed on the underside of the boom 30, and the channel members 70 have open sides facing towards each other. These channel members 70 each have a web 72, a lower flange 74 on which the rollers or wheels 62 of the trolley member 44 run, and an upper flange 76 which is welded or otherwise affixed onto the boom 30. Here, the boom is of box-type construction with a lower flange 78 to which the channel members 70 are welded, and upper flange 80, and right and left webs 82 defining sides of the boom 30. The lower flanges 74 extend towards each other, but leave a gap through which the depending finger 68 can extend, and through which the cylinder rod 48 can reach the rear protuberance 66 of the trolley member 44.

While the invention has been described in detail herein with respect to a preferred embodiment, it should be understood that the invention is not limited to that embodiment, and that many modifications and variations thereof would be apparent to those skilled in the art without departure from the scope and spirit of this invention, as defined in the appended claims.

I claim:

1. A heavy duty excavator having a mobile undercarriage and an overcarriage rotatably mounted upon the undercarriage, said excavator further including a boom pivotally mounted at its proximal end in the overcarriage, a first hydraulic means acting between the overcarriage and the boom for raising and lowering the boom in an ar, rail means secured to the underside of the boom, a trolley movably mounted upon said rail means for movement thereover, a second hydraulic means acting between the boom and the trolley for driving the trolley back and forth over the rail means, a sheave mounted upon said trolley, a winch mounted upon said overcarriage, a cable means wound about the winch and having a free end passing through said sheave whereby the free end of the cable can be attached to a load, a quick disconnect shoe mounted in a pivot at the distal end of the boom, and a third hydraulic means acting between the shoe and the boom for moving the shoe about said pivot whereby a stick mounted tool connected to the shoe can be selectively positioned.

2. The excavator of claim 1 wherein said rail means includes a pair of opposed channel members secured to said boom.

3. The excavator of claim 2 wherein said trolley includes a body, a plurality of rollers mounted in said body arranged to ride in said channel members and means to connect the body to said second hydraulic means.

4. The excavator of claim 3 wherein said body further includes a depending member for supporting said sheave therein.

5. The excavator of claim 1 wherein said hydraulic means are double acting cylinders.

* * * * *

UNITED STATES PATENT AND TRADEMARK OFFICE

CERTIFICATE OF CORRECTION

PATENT NO. : 4,693,384

DATED : September 15, 1987

INVENTOR(S) : CHARLES P. GILMORE, JR.

It is certified that error appears in the above-identified patent and that said Letters Patent is hereby corrected as shown below:

Column 4, line 4 - "ar" should read "arc".

Signed and Sealed this

Nineteenth Day of April, 1988

*Attest:*

*Attesting Officer*

DONALD J. QUIGG

*Commissioner of Patents and Trademarks*